United States Patent [19]

Gutmann

[11] Patent Number: 4,961,320

[45] Date of Patent: Oct. 9, 1990

[54] CONVEYING AND STORAGE DEVICE FOR THERMOSENSITIVE PRODUCTS

[76] Inventor: Klaus Gutmann, Wagramerstrasse 93/2, A 1220 Wien, Austria

[21] Appl. No.: 313,980

[22] PCT Filed: May 19, 1988

[86] PCT No.: PCT/AT88/00035

§ 371 Date: Jan. 19, 1989

§ 102(e) Date: Jan. 19, 1989

[87] PCT Pub. No.: WO88/09467

PCT Pub. Date: Dec. 1, 1988

[30] Foreign Application Priority Data

May 20, 1987 [AT] Austria ..... 1287/87
May 13, 1988 [AT] Austria ..... 255/88

[51] Int. Cl.[5] ..... F25B 21/02

[52] U.S. Cl. ..... 62/3.2; 62/3.3; 62/3.6

[58] Field of Search ..... 62/3.3, 3.2, 3.6

[56] References Cited

U.S. PATENT DOCUMENTS

| | | | |
|---|---|---|---|
| 3,040,539 | 6/1962 | Gaugler | 62/3.6 |
| 3,075,360 | 1/1963 | Elfving et al. | 62/3 |
| 3,100,970 | 8/1963 | Elfving | 62/3 |
| 3,196,620 | 7/1965 | Elfving et al. | 62/3.2 |
| 3,220,472 | 11/1965 | Raskin | 165/172 |
| 3,241,604 | 3/1966 | Christensen | 165/47 |
| 3,290,177 | 12/1966 | Mole et al. | 62/3.2 X |
| 3,821,881 | 7/1974 | Harkias | 62/3 |
| 4,448,028 | 5/1984 | Chao et al. | 62/3.3 |
| 4,494,380 | 1/1985 | Cross | 62/3.2 |

FOREIGN PATENT DOCUMENTS

| | | |
|---|---|---|
| 0050473 | 4/1982 | European Pat. Off. . |
| 1113222 | 8/1961 | Fed. Rep. of Germany . |
| 1139858 | 11/1962 | Fed. Rep. of Germany . |
| 1243703 | 7/1967 | Fed. Rep. of Germany . |
| 8103411.3 | 8/1981 | Fed. Rep. of Germany . |
| 3019092 | 11/1981 | Fed. Rep. of Germany . |
| 3205549 | 8/1983 | Fed. Rep. of Germany . |
| 8614884.2 | 2/1987 | Fed. Rep. of Germany . |
| WO85/04948 | 11/1985 | PCT Int'l Appl. . |
| 4613323/13/-001482 | 1/1989 | U.S.S.R. . |

*Primary Examiner*—Lloyd L. King
*Attorney, Agent, or Firm*—Young & Thompson

[57] ABSTRACT

A conveying and storage device for thermosensitive products is disclosed wherein one or several Peltier elements are provided for temperature control of the storage chamber, tubular heat-conducting members or a one-piece heat-conductive molding being provided on the plate of the Peltier element or elements on the side of the storage chamber, and wherein the plate of the Peltier element or elements on the housing side is constituted by finned heat-exchange members. For the purpose of a maximally homogeneous heat removal and supply within the storage chamber, the tubular heat-conducting members, (3), forming in direct mutual contiguousness the inside of the storage chamber (2), are hollow molding of a readily heat-conducting material, or the one-piece heat-conductive molding (17) forming the inside of the storage chamber (2) is of a readily heat-conducting material.

7 Claims, 3 Drawing Sheets

CONVEYING AND STORAGE DEVICE FOR THERMOSENSITIVE PRODUCTS

The invention relates to a conveying and storage device for thermosensitive products wherein one or several Peltier elements are provided for controlling the temperature of the storage chamber, tubular heat-conducting members or a one-piece heat-conductive molding being arranged on the plate of the Peltier element or elements on the side of the storage chamber, and wherein the plate of the Peltier element or elements on the housing side is constituted by finned heat-exchange members.

In particular, a conveying and storage container for pharmaceuticals or the like is involved wherein such containers are to operate without moving parts at surrounding temperatures of +40° C. to 20° C.

In order to provide temperature control for the storage chamber, one or several Peltier elements are used in the type of device according to this invention; in case several such elements are employed they are connected in series in a cascade arrangement. The effect of such Peltier elements, as is known, is such that when a dc voltage is applied to a Peltier element, heat is withdrawn from one side of the element and transported to the other side of the Peltier element. When the direction of current flow is changed, the direction of heat transport changes as well, so that the storage chamber can either be cooled or heated by means of one and the same Peltier element.

In this connection, it has been known to utilize such Peltier elements for the cooling of iceboxes intended for camping and automobile trips. It is furthermore known to provide tubular heat-conductive moldings on the plate of the Peltier elements located on the side of the storage chamber.

The invention is based on the object of obtaining a maximally homogeneous temperature abduction within the storage chamber; in this connection, almost no temperature gradient is to exist within the storage chamber in order to achieve identical temperature conditions with respect to the entire content of the storage chamber.

According to this invention, this object has been attained by providing that the tubular heat-conducting members 3 forming in direct mutual contact the inside of the storage chamber are prismatic, hollow molded articles exhibiting in particular a quadrangular cross section and made of a readily heat-conducting material, or by providing that a one-piece heat-conductive molding 17 of a readily thermally conductive material, or that a one-piece molding with an integrated heat-distributing zone 19 of a readily heat-conductive material constitutes the inside of the storage chamber 2. Thereby, on the one hand, an especially good heat abduction is obtained between the Peltier element 1 and the storage chamber, the inside of the storage chamber being located at such a distance from the Peltier element that it cannot lead to damage to the stored items on account of local subcooling or, in case of heating, to local hot spots.

Advantageously, the walls 7 of the storage chamber 2, likewise made of readily heat-conductive material, can be attached by means of screws, blind rivets or the like, or by means of heat-conductive adhesive to the outermost tubular heat-conducting members 3 or to the external lateral faces of the one-piece heat-conductive molding 17 or to the outer lateral faces of the one-piece molding with integrated heat-distributing zone 19. This design of the storage chamber effects fast heat abduction or, in case of heating operation, a quick supply of heat, a good heat transfer to the walls 7 of the storage chamber 2 being achieved via the outermost tubular heat-conducting members 3 or via the outer lateral surfaces of the one-piece heat-conductive molding 17 or via the outer lateral faces of the one-piece molding with integrated heat-distributing zone 19, whereby the entire walls of the storage chamber are available for heat transfer.

In this arrangement, the tubular heat-conducting members or the one-piece heat-conductive molding can be tightly mounted to the plate of the Peltier element 1 on the storage chamber side by means of clamp rails 5. A heat-distributing panel 18 can be interposed between the tubular heat-conducting members 3 or the one-piece heat-conductive molding 17 whereby an especially uniform heat distribution is obtained over the walls 7 of the storage compartment 2. This heat-distributing panel can be an integral part of the one-piece thermal molding 17 whereby such a one-piece molded article with integrated heat-distributing zone 19 takes over on its own the heat distribution and conduction between the Peltier element 1 and the walls 7 of the storage chamber 2.

In order to prevent the abduction of the heat emanating from an electronic control circuit 12 from having an adverse effect on the action of the Peltier element or elements, the finned heat-exchange member 9 of the Peltier element can be located separately from the finned cooling member 13 for cooling an electronic control circuit; between the finned heat exchanger and the finned cooling member, heat-insulating zones of the housing are arranged.

The drawing shows one embodiment of the subject of the present invention.

Figure 1:
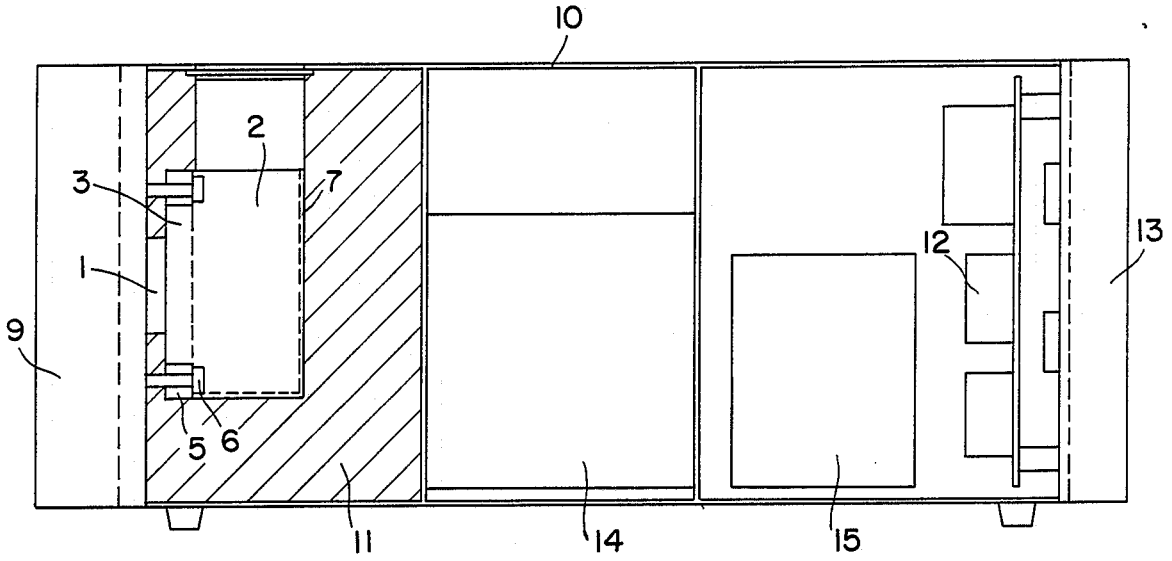
FIG. 1 shows a lateral view of the present invention with the external housing sidewall having been removed.
Figure 2:
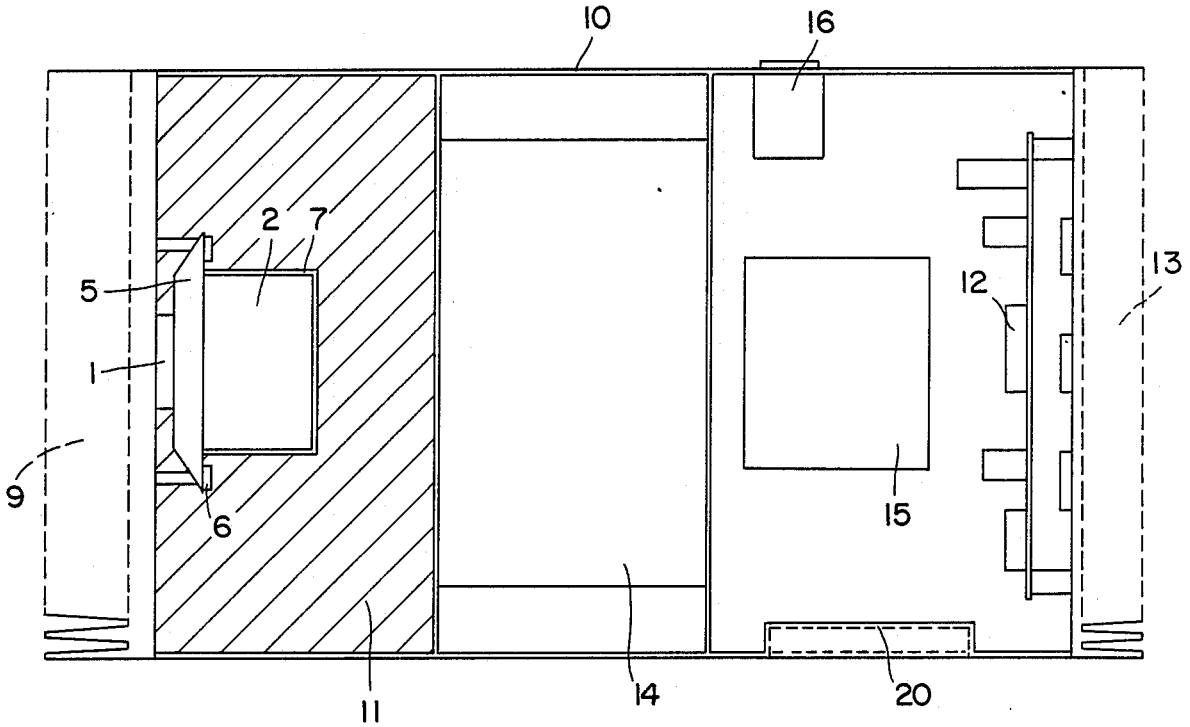
FIG. 2 is a top view on the arrangement with the top wall of the housing removed.
Figure 4:
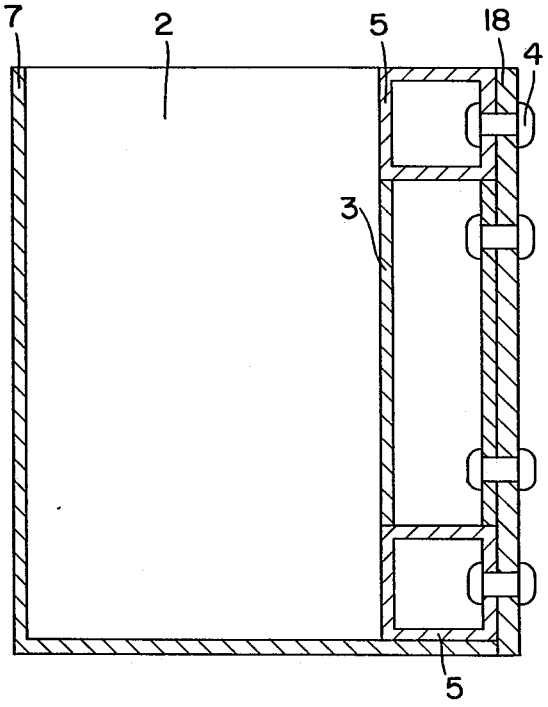
FIG. 4 is a cross section through the storage chamber with tubular heat-conducting members.
Figure 3:
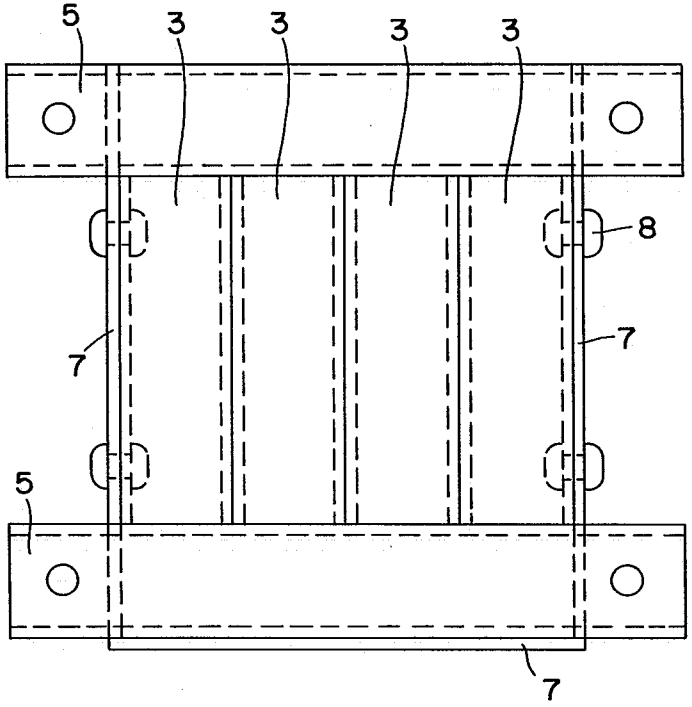
FIG. 3 shows a detailed view of the wall of the storage chamber formed from tubular heat-conducting members, on the side of the Peltier element.
Figure 7:
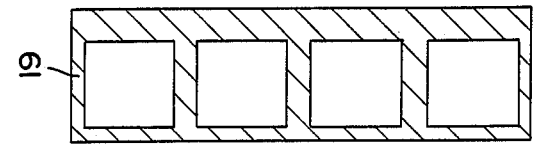
FIG. 7 shows the cross section through a one-piece molding with integrated heat-distributing zone.
Figure 6:
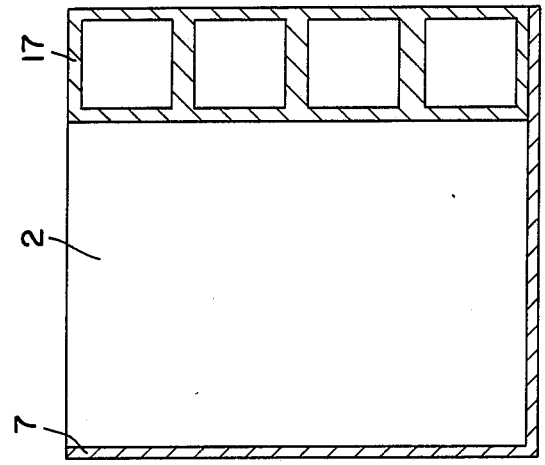
FIG. 6 shows a cross-sectional view of a storage chamber with one-piece heat-conductive molding.
Figure 5:
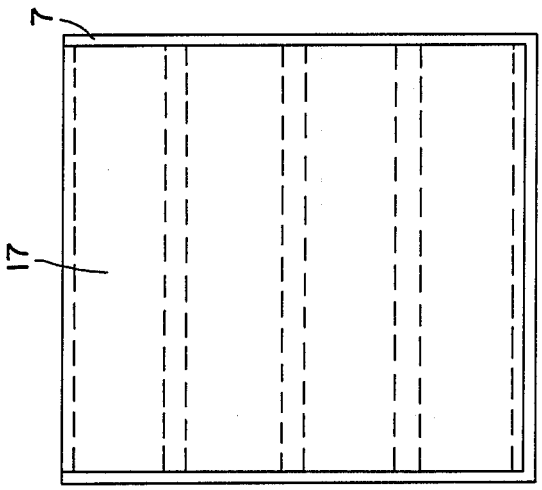
FIG. 5 shows a detailed view of the wall of the storage chamber formed from a one-piece heat-conductive molding, on the side of the Peltier element.

Numeral 1 denotes a Peltier element, a heat-distributing panel 18 being arranged on one side thereof facing a storage chamber 2. Tubular heat-conducting members 3 are disposed at this heat-distributing panel, constituted in the present case by shaped aluminum tubes having a square cross section. The walls of the heat-conducting members 3 facing the storage chamber 2 simultaneously form the inner wall of the storage chamber 2. The heat-conducting members 3 can be connected by means of screws, blind rivets, or the like, as indicated at 4 in FIG. 4. The heat-conducting members 3 are tightened against the Peltier element 1 by means of clamp rails 5, namely with the aid of screws 6.

The walls 7 of the storage chamber 2 are attached to the outermost heat-conducting members 3, namely likewise by means of screws, blind rivets, or the like, denoted by 8. The walls of the storage chamber are likewise made of a readily heat-conducting material.

The part of the Peltier element 1 facing away from the storage chamber is connected with a finned heat-exchange member 9, by way of which the heat removed from the storage chamber 2 is carried away by the Peltier element. If the Peltier element is utilized for heating then the heat required for the heating operation is absorbed from the ambient air by way of the finned heat-exchange member 9.

The storage chamber 2 is located in a housing 10 and is surrounded by a heat insulation 11. In this housing 10 an electronic control circuit 12 is furthermore disposed, this circuit being located in the close proximity to a finned cooling member 13 to carry away the heat produced at that location. The finned cooling member 13 of the electronic control circuit is arranged spatially separately from the finned heat-exchange member 9 of the Peltier element, a thermally insulating zone of the housing being disposed between the two members.

The housing 10 furthermore contains a buffer accumulator 14, a transformer 15, a mains switch 16, and an operating panel 20 with turn-on and turn-off switch to activate or deactivate the temperature control of the storage chamber. The built-in buffer accumulator 14 is designed in the present instance as a gastight accumulator permitting service-free operation independent of location. Regulation of the temperature within the storage chamber 2 is performed by way of a conventional temperature sensor arranged in close proximity to the tubular heat-conducting members 3, close to the one-piece heat-conductive molding 17, or close to the one-piece molding with integrated heat-distributing zone 19, this sensor being connected to the electronic control circuit 12.

The conveying and storage device according to this invention is very simple in its operation since it exhibits merely turn-on switches for activating the temperature control of the storage chamber and, respectively, turn-off switches for inactivation, as well as a mains switch. The remaining control and, with external energy supply, the charging of the built-in buffer accumulator take place automatically.

I claim:

1. Conveying and storage device for thermosensitive products, comprising a storage chamber, at least one Peltier element disposed adjacent one wall of said storage chamber for controlling the temperature within said storage chamber, and a plurality of hollow tubular heat-conducting members disposed adjacent said at least one Peltier element and defining said one wall of said storage chamber, wherein said plurality of hollow tubular heat-conducting members are prismatic in cross section and arranged in side-by-side relation between said storage chamber and said at least one Peltier element, thereby to define a substantially uniplanar heat-conducting surface facing into said storage chamber for maintaining a substantially uniform temperature within said storage chamber.

2. The conveying and storage device according to claim 1, wherein said plurality of hollow tubular heat-conductive members are integral with one another, and define a monolithic element having hollow heat-conducting passages formed therein and a plate-like surface defining said one wall of said storage chamber.

3. The conveying and storage device according to claim 1, further comprising at least one finned heat-exchange member disposed on a side of said at least one Peltier element opposite said storage chamber.

4. The conveying and storage device according to claim 1, wherein said storage chamber comprises five additional walls of a highly head-conductive material.

5. The conveying and storage device according to claim 1, further comprising clamping rails securing said plurality of hollow tubular head-conducting members to said at least one Peltier element.

6. The conveying and storage device according to claim 1, further comprising a heat-distributing panel disposed between said plurality of hollow tubular head-conducting members and said at least one Peltier element.

7. The conveying and storage device according to claim 6, wherein said heat-distributing panel and said plurality of hollow tubular heat-conductive members are formed integrally as a monolithic member having a plate-like surface defining said one wall of said storage chamber.

* * * * *